United States Patent [19]

Conroy

[11] 3,999,702

[45] Dec. 28, 1976

[54] MAILBOX STANDARD

[76] Inventor: Edward Jay Conroy, 626 Franklin St., Kent, Ohio 44240

[22] Filed: July 9, 1975

[21] Appl. No.: 594,545

[52] U.S. Cl. ..... 232/39; 248/145; 248/417

[51] Int. Cl.[2] ..... B65D 91/00

[58] Field of Search ..... 232/39; 248/145, 417, 248/128; 108/137, 152

[56] References Cited

UNITED STATES PATENTS

| | | | |
|---|---|---|---|
| 1,522,830 | 1/1925 | Nichols | 248/145 |
| 1,848,183 | 3/1932 | Madsen | 248/417 |
| 1,862,755 | 6/1932 | Madsen | 248/417 |
| 1,897,676 | 2/1933 | Ries | 248/417 |
| 2,329,697 | 9/1943 | Davies | 248/417 |
| 3,020,798 | 2/1962 | Chrisman | 248/145 X |
| 3,207,464 | 9/1965 | Hrach | 248/417 |
| 3,802,656 | 4/1974 | Virblas | 248/145 |
| 3,899,150 | 8/1975 | Racquet | 248/145 |

*Primary Examiner*—Roy D. Frazier
*Assistant Examiner*—Peter A. Aschenbrenner
*Attorney, Agent, or Firm*—Oldham & Oldham Co.

[57] ABSTRACT

A mailbox standard for maintaining roadside mail receptacles. Fundamentally, the invention includes a vertical post inserted into the ground and having extending therefrom, and perpendicular thereto, a horizontal member upon which the mailbox may be maintained. The horizontal member is rotational with respect to the vertical member and is biased by either gravity or mechanical biasing devices to maintain a predetermined normal position.

3 Claims, 6 Drawing Figures

MAILBOX STANDARD

BACKGROUND OF THE INVENTION

In many rural and suburban areas, it has been known to place the receptacles for mail service along the roadside at a height from the ground and distance from the roadbed as directed by law or safe practice. Inherent with common mail receptacles and the standards therefor, is the requirement that the owners of such receptacles enter upon the roadway surface to retrieve the mail deposited therein. Such requirement is, of course, hazardous to such owners since it places them in a vulnerable position with respect to vehicles using the roadway.

Heretofore an approach to alleviate the problem just described has been the use of mail receptacles having dual doors. Such receptacles have, however, not been well received for numerous reasons including the inherent cost increase to provide a receptacle having such a convenience. Yet further, it has been found that often times the insertion of mail into one end of the receptacle forces the opening of the opposite end of the receptacle, thus allowing the same to be open to the elements.

A further problem incident with the common mail receptacle and standard therefor is that the receptacle is fixed with respect to the standard and there is no resiliency or relative movement allowed therebetween. Consequently, if such boxes are hit, for example, by thrown objects, the receptacle is often times irreparably damaged because no means are provided for allowing the receptacle to move with the force of impact, thus absorbing the energy and momentum of the missile.

In view of the foregoing, it is an object of the instant invention to provide a mailbox standard which allows access to the interior of the mail receptacle at any point above the standard.

Yet a further object of the invention is to provide a mailbox standard which provides for such access to the interior of the receptacle and wherein such receptacle can be a single doored unit.

Still another object of the invention is to provide a mailbox standard which allows the mail receptacle to take any position in a radial plane about the standard but which has a fixed return point at which such receptacle is normally positioned.

Another object of the invention is to provide a mailbox standard of such nature that the mailbox is movable with respect thereto and thus protected from projected missiles and the like.

Still a further object of the invention is to provide a mailbox standard which is inexpensive to construct, reliable and durable in operation, and readily constructed from state of the art elements.

These objects and other objects which will become apparent as a detailed description proceeds are achieved by: A mailbox standard comprising a vertical member for insertion into the ground; a rotatable member rotationally engaged with the vertical member; and a horizontal support member connected to said rotating member and securing a mailbox at the end thereof, the rotatable member being biased to maintain a predetermined position with respect to the vertical member in the absence of externally applied force.

DESCRIPTION OF THE DRAWINGS

For a complete understanding of the objects, structures, and techniques of the invention, reference should be had to the following detailed description and accompanying drawings wherein.

DETAILED DESCRIPTION

Figure 1:
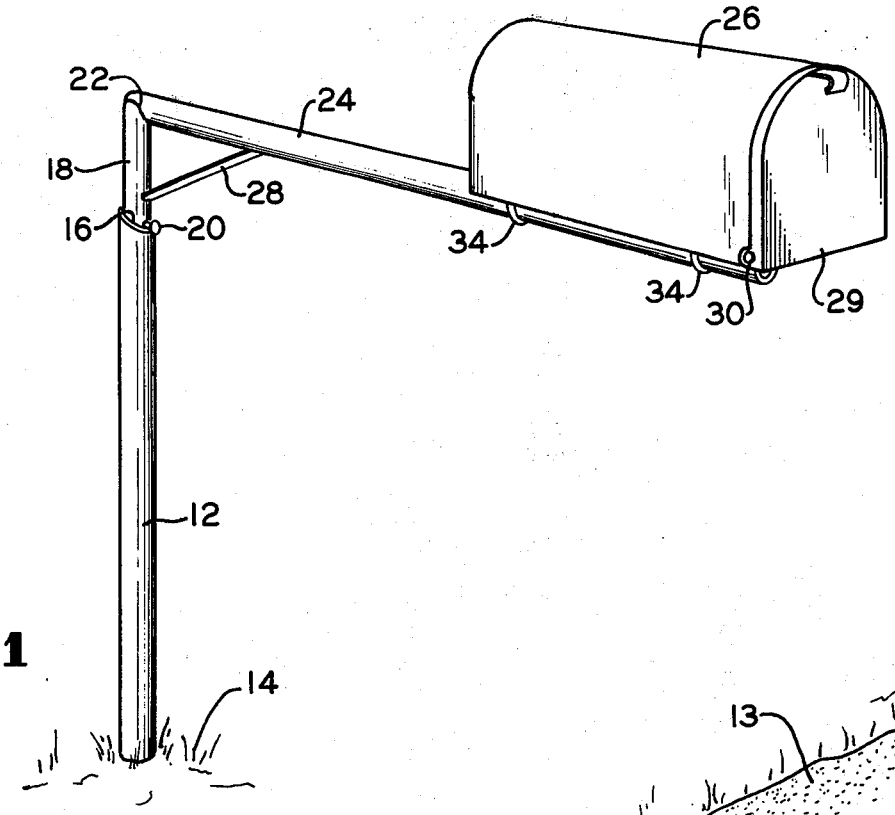
FIG. 1 is a pictorial view of the basic structure of the invention.

Referring now to the drawings and more particularly FIG. 1, a basic understanding of the preferred embodiment of the invention may be had. This embodiment, designated generally by the numeral 10, teaches the utilization of a tubular member 12 inserted into the ground 14 to a sufficient depth to secure the standard and make the same unaffected by ground swelling and the like. The tubular member 12 is cut on a bevel or angle as at 16 so as to create a cam face thereat. A second tubular member 18, of lesser outside diameter than the inside diameter of the member 12, is inserted into the tubular member 12 and supported on a pin 20 welded or otherwise secured to the member 18. As can be seen, tubular member 18 may be rotated within the tube 12 with the pin 20 tracking on the cam face 16.

It should of course be readily apparent that the tube 18 might indeed have an inside diameter greater than the outside diameter of the member 12 with the pin 20 then extending into the interior of the member 18. In such case, the tubular member 18 is placed over the member 12 and the contacting engagement between the pin 20 and cam face 16 is covered and protected from the elements. In either event, the functional result is the same.

Affixed to the tubular member 18 by weld joint 22 or the like is a horizontal tubular member 24. The member 24 extends at right angles with respect to the tubes 12, 18 and is operative to receive thereon the mail receptacle 26. For purposes of added strength, a gusset or brace 28 may be added by welding or the like between the tubular members 18 and 24. The box 26 is of conventional construction having a door 29 hingedly connected as at 30 at one end thereof. Appropriate handle means 32 are provided for facilitating the opening and closing of the box 26. U-bolts 34 or other appropriate fasteners are provided for making securing engagement between the box 26 and the horizontal support member 24. As will be discussed hereinafter, a tray or the like may be first affixed to the member 24 and the box 26 then secured to each tray.

It should now be readily apparent that in operation the mail receptacle standard 10 maintains the position as shown in FIG. 1; that is, with the pin 20 at the lower most point of the cam surface 16. The standard 10 is erected with the post 12 in the ground 14 at such a point as to place the box 26 perpendicular to and in proper spaced relationship from the roadway surface 13. The mail carrier may then deposit the mail into the receptacle 26 from the roadway 13 in the normal fashion. To retrieve mail from the box, the owner thereof need only rotate the support member 24 about the axis defined by the verticle tubular member 12 causing the pin 20 to rotate upward about the cam face 16 and thus allowing access to the receptacle 26 from a point remote from the dangers of the roadway surface 13. It should be readily apparent that as the support member 24 is rotated 180° from the position shown in FIG. 1, it maintains a position of maximum potential energy such that release of the member 24 will urge the same to its normal position of least potential energy as shown in FIG. 1. Thus, the mailbox standard of the invention has a common position which it seeks to obtain, that position being preferably directed towards the road surface.

Figure 2:
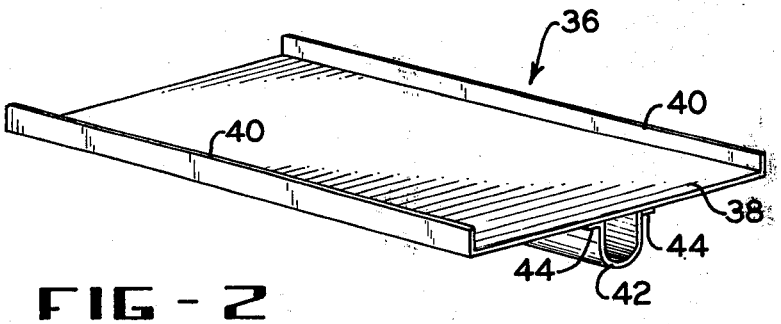
FIG. 2 is a pictorial view of a mail receptacle tray which might be utilized in conjunction with the structure of FIG. 1.

As shown in FIG. 2, the U-bolts 34 of FIG. 1 may be replaced by means of an appropriate tray 36. This tray includes a flat bed portion 38 bent upwardly at the ends thereof into flanges 40 and having affixed at the bottom thereof an appropriate sleeve 42. This sleeve is adaptable for sliding over and making securing engagement with the horizontal support member 24 and is affixed to the bottom of the bed 38 by welding or the like as at 44. The tray may be adapted for securing and retaining a plurality of mailboxes arranged in side by side relationship between the flanges 40 and parallel to the sleeve 42. Of course, appropriate means such as sheet metal screws or the like may be utilized for securing the boxes to the tray bed 38. It has been found that as many as four boxes may be positioned on a single tray associated with a single standard.

Figure 3:
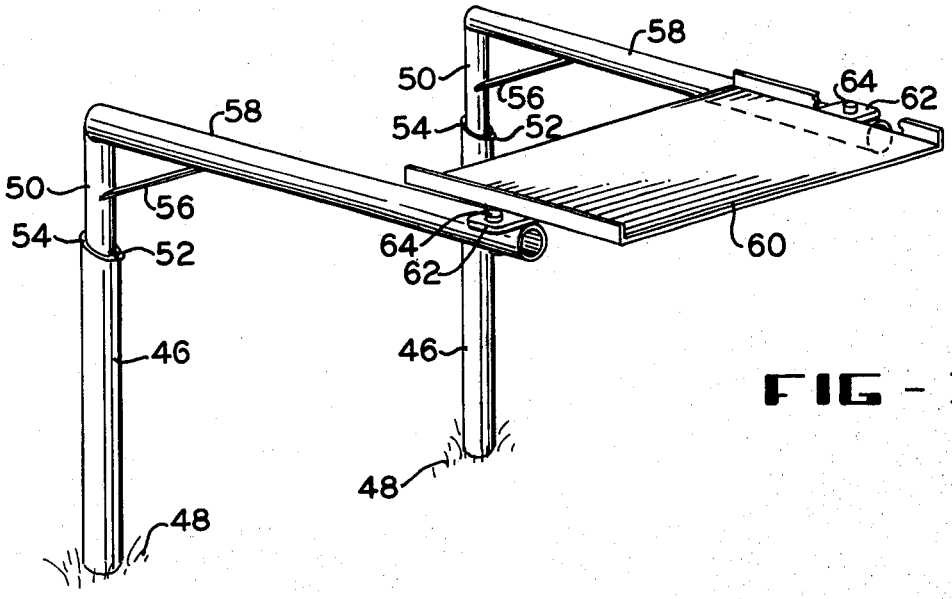
FIG. 3 is a pictorial view of an embodiment of the invention utilizing a dual standard and functional for receiving and maintaining a plurality of mail receptacles.

A unique variation on the basic theme of the invention is presented in FIG. 3 wherein there is shown a mailbox standard for gang mounting of the boxes. This unit is particularly adapted for utilization with multifamily dwellings wherein a single station is responsible for servicing any of a large number of residents, each resident having its own mail receptacle.

The embodiment of FIG. 3 incorporates two tubular members 46 inserted into the ground 48 and receiving therein second tubular members 50 of lesser outside diameter than the inside diameter of the members 46. Each of the tubular members 50 is again characterized by the presence of a pin 52 welded or otherwise appropriately affixed thereto and operative to track along the cam surfaces 54. Again, gussets or braces 56 may be utilized for reinforcing the engagement between each horizontal tubular members 58 and its respective element 50.

A tray 60, similar in nature to that discussed hereinabove but of sufficient width to receive a substantial plurality of mailboxes, is adapted to be received between the ends of the tubular members 58. Secured at each end of the tray 60 is a block 62 having a vertical hole passing therethrough. A pin 64 affixed near the end of each of the tubular members 58 makes pivotal engagement with the hole within the block 62, thus retaining the tray 60 in proper position. It should be readily apparent that the presence of the tray 60 maintains the arms 58 in parallel relationship with each other and that any person having a mailbox retained upon the tray 60 may grasp either of the arms 58 and rotate the tray 60 with its associated mailboxes away from the roadway surface and to the owner for inspection. Upon release, the composite 58, 60, again gravitates by virtue of the engagement of the pins 52 with the cam faces 54 to a point of least potential energy; that point being preferably toward the roadway surface. It should be readily apparent that design criteria dictates that the distance between the tubular members 56 must be greater than the length of the tubular members 58 to allow a complete 360° rotation.

Figure 4:
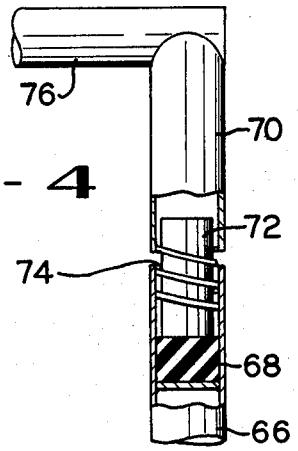
FIG. 4 is a variation on the basic theme of the invention utilizing a biasing block to maintain the box at a standard position.

A variation on the basic theme of the invention is shown in FIG. 4 wherein the cam face and pin relationship are alleviated and a mechanical biasing means provided. Here it can be seen that the ground shaft 66 has contained therein a resilient rubber block 68 and the upper tubular member 70 has a plunger 72 affixed thereto and threadily connected with the tube 66 as at 74. In operation, the system normally sets with the plunger 72 resting upon the rubber block 68 with the horizontal tubular member 76 maintaining the mailbox in a direction toward the roadway surface. The user may then rotate the horizontal member 76 in such direction as to cause the loose threading engagement at 74 to tighten such as to force the plunger 72 into compacting engagement with the resilient rubber block 68. When the mail is removed from the box, the owner releases the member 76 and the resilient block seeks to expand thus rotating the element via the threaded connection at 74 to the quiescent state wherein the member 76 is again directed toward the roadway surface. As can be seen, the rotating of the member 70 loads or cocks the block 68 and prepares the same to automatically return the system upon release.

Figure 5:
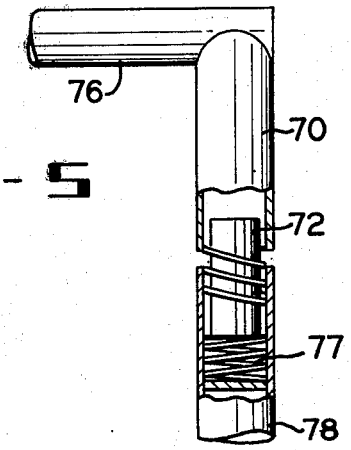
FIG. 5 is a variation on the basic theme of the invention utilizing a coil spring for returning the mail receptacle to a standard position.

Still another variation on the theme of the invention is shown in FIG. 5 and is quite similar to that embodiment presented in FIG. 4. In this case, a spring 77 is provided in fixed engagement with the lower tubular member 78. The upper tubular member is similar in nature to that of FIG. 4. Suffice it to say that the threading engagement, again similar to that of FIG. 4 between the upper and lower tubular members, provide for the swinging of the mailbox from the roadway surface to the owner. Upon release of the upper tubular member, the loaded spring 76 is operative to cause the unit to return to its standard position via the threaded engagement between the upper and lower tubular members.

Figure 6:
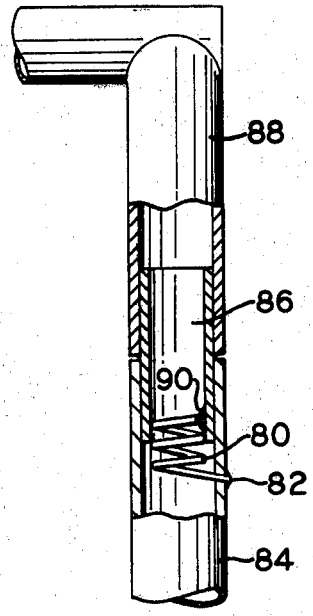
FIG. 6 is a variation on the basic theme of the invention utilizing a biasing spring for returning the mailbox to a standard position.

The embodiment shown in FIG. 6 teaches a spring 80 affixed at 82 to the lower tubular member 84. An insert 86 is welded or otherwise affixed to the upper tubular member 88 and has an eye 90 connected to an inner surface thereof. This portion of the insert 86 fits within the tubular member 84 with the eye making securing engagement with the spring 80. It should now be readily apparent that rotation of the upper tubular member 88 loads or cocks the spring 80 such that, upon release of the mailbox, the tubular member 88 is caused to rotate back to its unbiased position with the mailbox directed towards the roadway surface.

Thus it can be seen that the objects of the invention have been satisfied by the structures presented and described hereinabove. While in accordance with the patent statutes only the best mode and preferred embodiments of the invention have been presented and described in detail, it is to be understood that the invention is not limited thereto or thereby. Consequently, for an appreciation of the scope and breadth of the invention, reference should be had to the following claims.

What is claimed is:

1. A standard for maintaining a roadside receptacle, comprising:

a first vertical shaft for insertion into the ground;

a second vertical shaft concentrically mounted with respect to said first shaft and rotatable thereabout, first biasing means interconnecting said first and second vertical shafts for urging said shafts into a predetermined rotational position with respect to each other;

a first horizontal member fixedly secured to and normal with the second vertical member;

a third vertical shaft for insertion into the ground;

a fourth vertical shaft concentrically mounted with respect to said third shaft and rotatable thereabout;

second biasing means interconnecting said third and fourth vertical shafts for urging said third and fourth shafts into a predetermined rotational position with respect to each other;

a second horizontal member fixedly secured to and normal with the fourth vertical member; and securing means pivotally interconnected between a point on each of said horizontal members for securing said receptacle thereto.

2. The standard as recited in claim 1 wherein said shafts are tubular members and wherein each of said first and second biasing means respectively comprise a beveled cam face on the top of said first and third vertical shafts and a pin protruding from said second and fourth vertical shafts, said pins being in tracking engagement with the cam faces.

3. The standard as recited in claim 2 wherein said securing means includes a tray pivotally mounted atop said horizontal members and receiving and securing at least one receptacle.

* * * * *